US010119091B2

(12) United States Patent
Saccomando et al.

(10) Patent No.: US 10,119,091 B2
(45) **Date of Patent: *Nov. 6, 2018**

(54) ANTI-CORROSION ADDITIVES

(71) Applicant: The Lubrizol Corporation, Wickliffe, OH (US)

(72) Inventors: Daniel J. Saccomando, Belper (GB); Ewan E. Delbridge, Concord Township, OH (US); William R. S. Barton, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 24 days.

This patent is subject to a terminal disclaimer.

(21) Appl. No.: 15/306,654

(22) PCT Filed: Apr. 28, 2015

(86) PCT No.: PCT/US2015/027996

§ 371 (c)(1),
(2) Date: Oct. 25, 2016

(87) PCT Pub. No.: WO2015/171364

PCT Pub. Date: Nov. 12, 2015

(65) Prior Publication Data

US 2017/0240836 A1 Aug. 24, 2017

Related U.S. Application Data

(60) Provisional application No. 61/989,299, filed on May 6, 2014.

(51) Int. Cl.

| | |
|---|---|
| ***C10M 133/06*** | (2006.01) |
| ***C10M 141/08*** | (2006.01) |
| ***C10M 141/10*** | (2006.01) |

(52) U.S. Cl.

CPC ..... *C10M 133/06* (2013.01); *C10M 141/08* (2013.01); *C10M 141/10* (2013.01); *C10M 2215/04* (2013.01); *C10M 2219/106* (2013.01); *C10M 2223/04* (2013.01); *C10M 2223/047* (2013.01); *C10N 2230/04* (2013.01); *C10N 2230/06* (2013.01); *C10N 2230/10* (2013.01); *C10N 2230/12* (2013.01); *C10N 2240/04* (2013.01); *C10N 2240/042* (2013.01); *C10N 2240/044* (2013.01)

(58) Field of Classification Search

CPC ..... C10M 133/06; C10M 141/08; C10M 141/10; C10M 2215/04; C10M 2219/106; C10M 2223/04; C10M 2223/047; C10N 2230/04; C10N 2230/06; C10N 2230/10; C10N 2230/12; C10N 2240/042; C10N 2240/044

See application file for complete search history.

(56) References Cited

U.S. PATENT DOCUMENTS

| | | | | |
|---|---|---|---|---|
| 3,397,145 | A | 8/1968 | Cyba et al. | |
| 6,596,673 | B1 * | 7/2003 | Bovington | C10M 163/00 508/436 |
| 2012/0015855 | A1 * | 1/2012 | Saccomando | C07C 211/21 508/476 |
| 2012/0040876 | A1 | 2/2012 | Preston et al. | |
| 2015/0291907 | A1 * | 10/2015 | Saccomando | C10M 133/04 508/476 |

FOREIGN PATENT DOCUMENTS

| | | | | |
|---|---|---|---|---|
| WO | 2013013026 | A1 | 1/2013 | |
| WO | WO 2013013026 | A1 * | 1/2013 | C07D 207/277 |
| WO | 2015171356 | A1 | 11/2015 | |
| WO | 2015171674 | A1 | 11/2015 | |

* cited by examiner

*Primary Examiner* — James Goloboy
(74) *Attorney, Agent, or Firm* — Michael Miller; David Shold

(57) ABSTRACT

A lubricant composition comprising an oil of lubricating viscosity and an N-hydrocarbyl-substituted aminoester, wherein the N-hydrocarbyl substituent comprises a hydrocarbyl group of at least 3 carbons atoms, with a branch at the 1 or 2 position of the hydrocarbyl chain, provides good iron and copper corrosion performance in driveline or gear applications.

23 Claims, No Drawings

ANTI-CORROSION ADDITIVES

BACKGROUND OF THE INVENTION

The disclosed technology relates to additives that impart corrosion protection against both iron and copper corrosion to a lubricant formulation, particularly for gear lubrication or lubrication of driveline devices.

Balancing the multiple requirements of a driveline fluid presents unique challenges. Driveline lubricants, which are designed to lubricate one or more of transmissions, axles, bearings, and gears, and also contacting electronic componentry, casings or housings, and other components, must meet the requirements for lubrication of each of the components while protecting metals from corrosion and, in many instances, elastomeric seals from degradation. Alkyl amine compounds, for example, are useful as iron corrosion inhibitors in driveline applications, but they may lead to corrosion of copper-containing components.

U.S. Patent Publication 2012-0040876, Preston et al., Feb. 16, 2012, discloses anthranilic esters as additives in lubricants. This document discloses compositions that are said to deliver an ash-free base to a lubricant in the form of a basic amine additive, without adversely impacting seal compatibility.

SUMMARY OF THE INVENTION

The disclosed technology provides a lubricant composition comprising an oil of lubricating viscosity and an N-hydrocarbyl-substituted aminoester of certain structures, wherein the N-hydrocarbyl substituent comprises a hydrocarbyl group of at least 3 carbons atoms, with a branch at the 1 or 2 position of the hydrocarbyl chain (that is, of the hydrocarbyl group). In certain embodiments, if the ester is a methyl ester then the hydrocarbyl group has a branch at the 1 position, and in certain embodiments the hydrocarbyl group is not a tertiary group. In one embodiment the hydrocarbyl group is not a tertiary group and, if the ester is a methyl ester, then the hydrocarbyl group has a branch at the 1 position. The lubricant composition may also typically comprise a substituted thiadiazole or an amine (thio)phosphate or both thereof.

The N-hydrocarbyl-substituted amino esters as described herein are useful to provide good iron corrosion (rust) protection as typically measured by humidity cabinet testing while not leading to copper corrosion as typically measured by the ASTM D130 test.

DETAILED DESCRIPTION OF THE INVENTION

Various preferred features and embodiments will be described below by way of non-limiting illustration.

The disclosed technology will typically be presented in a lubricant or lubricant formulation, one component of which will be an oil of lubricating viscosity. The oil of lubricating viscosity, also referred to as a base oil, may be selected from any of the base oils in Groups I-V of the American Petroleum Institute (API) Base Oil Interchangeability Guidelines, namely

| Base Oil Category | Sulfur (%) | Saturates(%) | Viscosity Index |
|---|---|---|---|
| Group I | >0.03 and/or | <90 | 80 to 120 |
| Group II | ≤0.03 and | ≥90 | 80 to 120 |

-continued

| Base Oil Category | Sulfur (%) | Saturates(%) | Viscosity Index |
|---|---|---|---|
| Group III | ≤0.03 and | ≥90 | >120 |
| Group IV | All polyalphaolefins (PAOs) | | |
| Group V | All others not included in Groups I, II, III or IV | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The lubricant composition of the disclosed technology will include an N-hydrocarbyl-substituted aminoester. The amino group will typically be separated from the carbonyl carbon of the ester group by a chain of 3 or 4 carbon atoms (as shown in the structure below), which chain may optionally be further substituted. Suitable substituted aminoester may thus be generally depicted as a materials represented by the formula

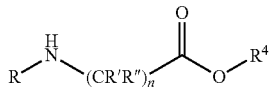

where R and $R^4$ are hydrocarbyl substituents ($R^4$ may be viewed as the residue of the alcohol from which the ester may be envisioned as having been prepared by condensation of an amino acid with an alcohol). In the formula, n is 3 or 4, representing the 3 or 4 carbon atoms separating the amino group from the ester group. The R' and R" groups may each independently be hydrogen, a hydrocarbyl group (of 1 to 30, or 1 to 6, or 1, or 2 carbon atoms), or an ester group —C(O)$OR^4$.

The group $R^4$, may have 1 to 30 or 2 to 18 or 4 to 15 or 3 to 8 or 4 to 8 carbon atoms. It may be a hydrocarbyl group or a hydrocarbon group. It may be aliphatic, cycloaliphatic, branched aliphatic, or aromatic. In certain embodiments, the $R^4$ group may be methyl, ethyl, propyl, isopropyl, n-butyl, iso-butyl, t-butyl, n-hexyl, cyclohexyl, iso-octyl, or 2-ethylhexyl. If $R^4$ is methyl, then the R group, the hydrocarbyl substituent on the nitrogen, will have a branch at the 1-position. The R group is more fully defined below.

In other embodiments the $R^4$ group may be an ether-containing group. For instance, it may be an ether-containing group or a polyether-containing group which may contain, for instance 2 or 3 and up to, in some embodiments, 120 carbon atoms along with oxygen atoms representing the ether functionality. When $R^4$ is an ether-containing group, it may be represented by the general formula

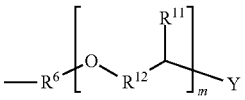

wherein $R^6$ is a straight- or branched-chain hydrocarbylene group of 1 to 30 or 2 to 8, or 2 to 4, or 2 carbon atoms; $R^{11}$ is H or a hydrocarbyl group of 1 to 10 carbon atoms, or 1 to 4 carbon atoms, or 1 to 2 carbon atoms; $R^{12}$ is a straight- or branched-chain hydrocarbylene group of 1 to 6 carbon atoms; Y is hydrocarbyl group or a hydrocarbon group, which may have 1 to 30 or 2 to 18 or 4 to 15 or 4 to 8 carbon atoms. It may be aliphatic, cycloaliphatic, branched aliphatic, or aromatic. Y may alternatively be —OH or —$NR^9R^{10}$, where $R^9$ and $R^{10}$ are each independently H or a hydrocarbyl group of 1 to 30 or 2 to 18 or 4 to 15 or 4 to 8 carbon atoms, and m is an integer from 1 to 50, 1 to 14, or 15 to 40, or 2 to 8. An example of a mono-ether group would be —$CH_2$—O—$CH_3$. Polyether groups include groups based on poly(alkylene glycols) such as polyethylene glycols, polypropylene glycols, and poly(ethylene/propylene glycol) copolymers. Such polyalkylene glycols are commercially available under the trade names UCON® OSP base fluids, Synalox® fluids, and Brij® polyalkylene glycols. They may be terminated with an alkyl group (that is, Y is H) or with a hydroxy group or other such groups as mentioned above. If the terminal group is OH, then $R^4$ would also be considered a hydroxy-containing group, much as described in the paragraph below (albeit not specifically a hydroxy-containing alkyl group) and may be esterified as described in the paragraph below.

In another embodiment, $R^4$ can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified hydroxy group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester. In one embodiment, one or more of the hydroxy groups within $R^4$ may be condensed with or attached to an additional

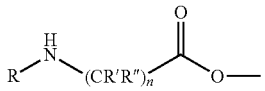

group so as to from a bridged species.

There may also be one or more additional substituents or groups within the $(CR'R'')_n$ group in the above molecule, as represented by R' or R". In one embodiment there are no such substituents. In another embodiment there may be a substituent leading to a group of materials such as those represented by the formulas

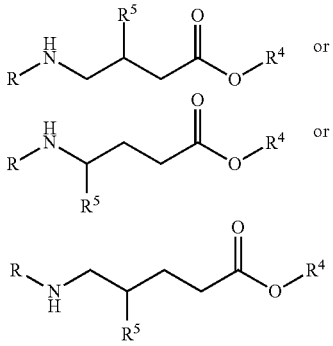

Here R and $R^4$ are as defined herein, and $R^5$ may be hydrogen, a hydrocarbyl group, or a group represented by —C(═O)—$R^6$ where $R^6$ is hydrogen, an alkyl group, or —$OR^7$, and $R^7$ is a hydrocarbyl group of 1 to 30 carbon atoms. That is, a substituent at the β position of the chain may comprise an ester, carbonyl, or hydrocarbyl group.

When $R^5$ is —C(═O)—$R^6$ and n is 3, the structure may be represented by

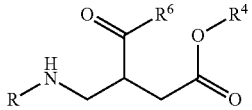

It will be evident that when $R^6$ is —$OR^7$ the material will be a substituted succinic acid ester. In one embodiment the material may be methyl succinic acid diester, with amine substitution on the methyl group. The $R^4$ and $R^6$ groups may be the same or different; in certain embodiments they may be as described above for $R^4$ (as when it is an ester). In certain embodiments, the material may be represented by the structure

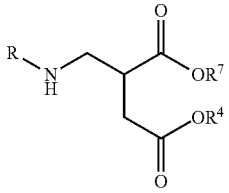

where $R^4$ and $R^7$ are as defined above and may be the same or different.

In certain embodiments the material will be or will comprise a 2-((hydrocarbyl)-aminomethyl succinic acid dihydrocarbyl ester (which may also be referred to as a dihydrocarbyl 2-((hydrocarbyl)aminomethyl succinate). When $R^5$ is —C(=O)—$R^6$ and n is 4, the structure may be represented by

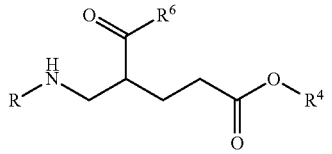

It will be evident that when $R^6$ is —O—$R^7$ the material will be a substituted pentanedioic acid ester. In particular, in one embodiment the material may be a 2-methyl pentanedioic acid diester, with amine substitution on the methyl group. The $R^4$ and $R^7$ groups may be the same or different; in certain embodiments they may independently have 1 to 30 or 2 to 18, or 4 to 15, or 4 to 8 carbon atoms, with other parameters as described above for $R^4$ and $R^7$ In certain embodiments, the material may be represented by the structure

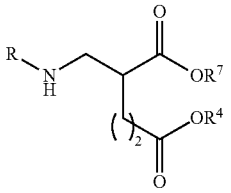

In certain embodiments the material will be or will comprise a 2-((hydrocarbyl)-aminomethyl) pentanedioic acid dihydrocarbyl ester (which may also be referred to as a dihydrocarbyl 2-(((hydrocarbyl)aminomethyl) glutaric acid dihydrocarbyl ester).

In certain embodiments, when n=4, there may be substituents at both the 2 and 3 position as represented in the formula

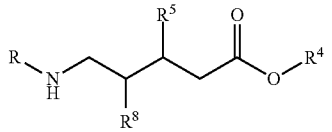

Here R, $R^4$, $R^5$ and are as defined above and $R^8$ may be a hydrocarbyl group or a group represented by —C(=O)—$R^6$ wherein $R^6$ is as defined above. The material may be represented by the structure

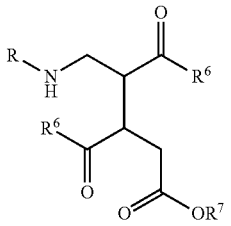

It will be evident that when $R^6$ is —O'—$R^7$ the material will be a substituted 1,2,3-tricarboxylic acid ester. In particular, in one embodiment the material may be a trihydrocarbyl 4-(hydrocarbylamino)butane-1,2,3-tricarboxylate.

The hydrocarbyl substituent R on the amine nitrogen will comprise a hydrocarbyl group of at least 3 carbon atoms with a branch at the 1 or 2 (that is, α or β) position of the hydrocarbyl chain R. The branched hydrocarbyl group R may be represented by the partial formula

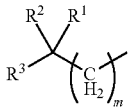

where the bond on the right represents the point of attachment to the nitrogen atom. In this partial structure, m may be 0 or 1, $R^1$ is hydrogen or a hydrocarbyl group, $R^2$ and $R^3$ are independently hydrocarbyl groups or together form a carbocyclic structure. The hydrocarbyl groups may be aliphatic, cycloaliphatic, or aromatic, or mixtures thereof. When m is 0, the branching is at the 1 or α position. When m is 1, the branching is at the 2 or β position. If $R^4$, above, is methyl, then m will be 0.

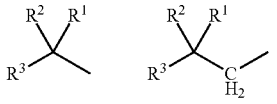

1- or α branching 2- or β branching

There may, of course, be branching both at the 1 position and the 2 position. Attachment to a cyclic structure is to be considered branching:

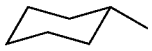

(a type of 1- or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

The amine that may be seen as reacting to form the material of the present technology will be a primary amine, so that the resulting product will be a secondary amine, having a branched R substituent as described above and the nitrogen also being attached to the remainder of the molecule

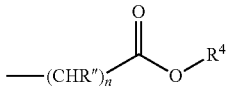

and substituted versions thereof as described above. The left-most (short) bond represents the attachment to the nitrogen atom.

The materials of the disclosed technology may therefore, in certain embodiments, be represented by the structure

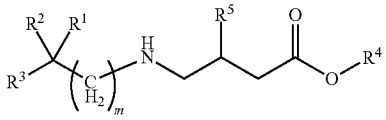

wherein m is 0 or 1, n is 1 or 2, $R^1$ is hydrogen or a hydrocarbyl group, $R^2$ and $R^3$ are independently hydrocarbyl groups or together form a carbocyclic structure, $R^4$ is a hydrocarbyl group of 1 to 30 carbon atoms as more fully described above, and $R^5$ is hydrogen, a hydrocarbyl group, or a group represented by —C(=O)—$R^6$ where $R^6$ is hydrogen, an alkyl group, or —O—$R^7$, and $R^7$ is a hydrocarbyl group of 1 to 30 carbon atoms. In certain embodiments, the materials may be represented by the structure

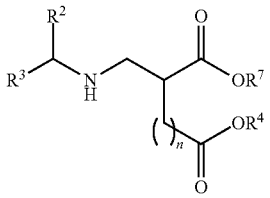

wherein n is 1 or 2, $R^2$ and $R^3$ are independently alkyl groups of 1 to 6 carbon atoms and $R^4$ and $R^7$ are independently alkyl groups of 1 to 12 carbon atoms. In other embodiments, the materials may be represented by the structure

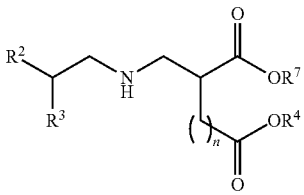

wherein $R^2$, $R^3$, $R^4$, $R^7$ and n are as defined above.

In certain embodiments m may be 0, $R^1$ may be methyl, and $R^2$ may be an aromatic group. In certain embodiments $R^4$ may be a butyl group. In certain embodiments $R^5$ may be an ester group. An example of a structure representing these selections is

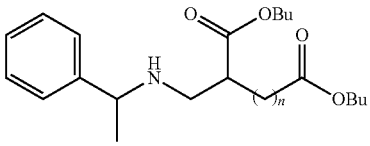

wherein n is 1 or 2 or in one embodiment n is 1.

In certain embodiments, the N-hydrocarbyl-substituted materials disclosed herein may be prepared by a Michael addition of a primary amine, having a branched hydrocarbyl group as described above, with an ethylenically unsaturated ester of the type described above. The ethylenic unsaturation would be between the carbon atoms of the ester as shown in the structure below. Thus, the reaction may occur generally as

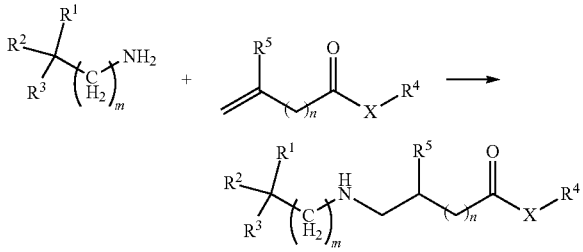

where the X and various R groups are as defined above, n=1 or 2 and m=0 or 1; in certain embodiments the $R^5$ group will be a group which activates the adjacent double bond to the addition reaction; e.g., $R^5$ may be an ester group. In one embodiment the ethylenically unsaturated ester may be an ester of itaconic acid, in which the reaction may be

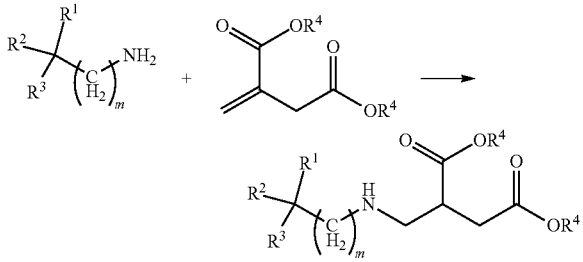

In one embodiment the ethylenically unsaturated ester may be an ester of 2-methylene glutaric acid (the 2 indicating the position of the methylene group) in which the reaction may be

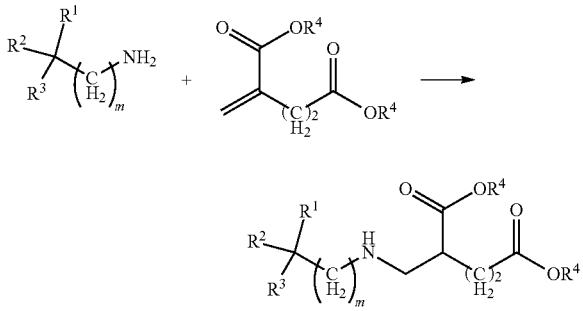

In one embodiment the ethylenically unsaturated ester may be an ester of a 3-but-3-ene-1,2,3-tricarboxylic acid in which the reaction may be

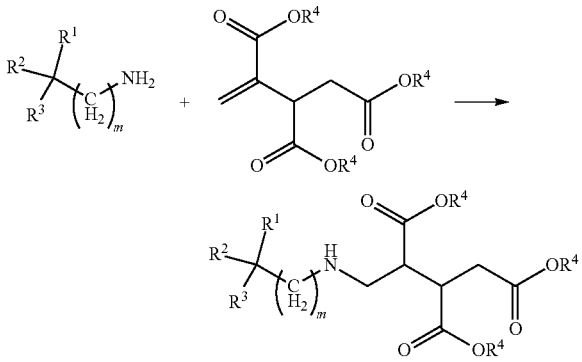

In other embodiments, the N-hydrocarbyl-substituted aminoester, materials disclosed herein may be prepared by reductive amination of the esters of 4- or 5-oxy substituted carboxylic acids.

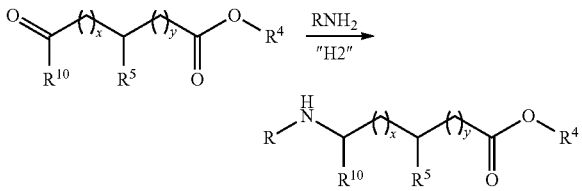

wherein x and y are 0 or 1 provided that x+y=1 or 2, and R, $R^4$, and $R^5$, are as defined above, and $R^{10}$ is H or an alkyl group having 1 to 4 carbon atoms. For example, reaction of α-methyl benzyl amine with butyl 5-oxopentanoate followed by selective hydrogenation of the resulting imine would yield butyl 5-(benzylamino)pentanoate.

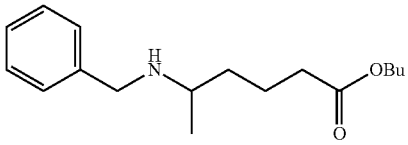

The N-hydrocarbyl-substituted aminoester materials disclosed herein may be prepared by amination of the esters of 4- or 5-halogen substituted carboxylic acids.

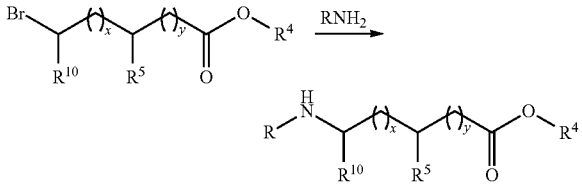

wherein x and y are 0 or 1 provided that x+y=1 or 2, and R, $R^4$, and $R^5$ are as defined above and $R^{10}$ is H or an alkyl group having 1 to 4 carbon atoms. For example reaction of α-methyl benzyl amine with 2-ethylhexyl 5-bromohexanoate would yield the hydro bromide salt of 2-ethylhexy-5-(benzylamino)hexanoate.

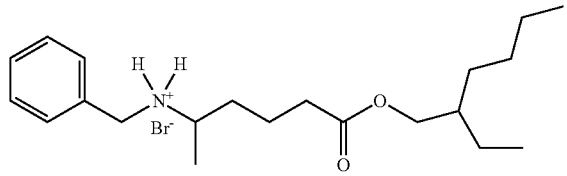

In such instances, when a hydrohalide is formed, the halide may be removed by known methods to obtain the amine.

The N-hydrocarbyl-substituted amino ester materials disclosed herein may be prepared by reductive amination of the esters of 2-amino substituted pentanedioic acids or 2-amino substituted hexanedioc acids.

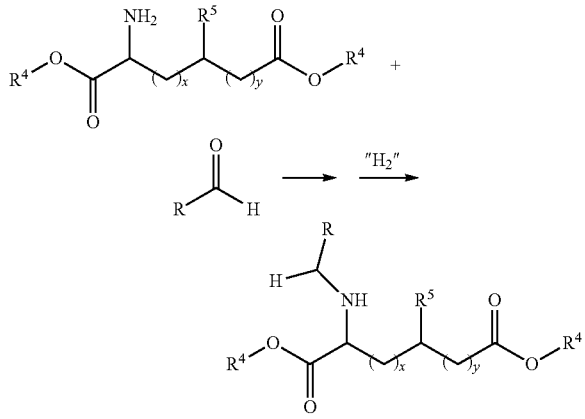

wherein x and y are 0 or 1 provided that x+y=1 or 2, and R, $R^4$, $R^5$ are as defined above. For example, the reaction of the dibutyl ester of 2-aminoadipic acid with benzaldehyde followed by selective hydrogenation of the imine would yield dibutyl 2-(benzylamino)hexanedioate.

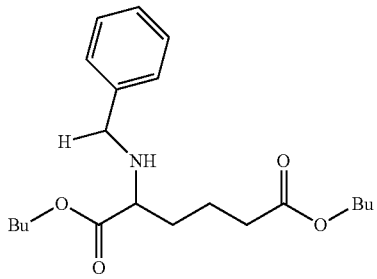

The N-hydrocarbyl-substituted aminoester materials disclosed herein may be prepared by alkylation of the esters of 2-amino substituted pentanedioic acids or 2-amino substituted hexanedioc acids.

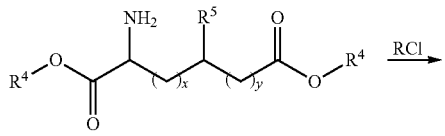

-continued

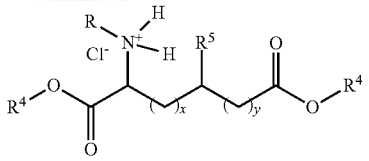

wherein x and y are 0 or 1 provided that x+y=1 or 2, and R, $R^4$, $R^5$ are as defined above. For example, the reaction of the dibutyl ester of 2-aminoadipic acid with benzyl amine would yield N-benzyl-1,6-dibutoxy-1,6-dioxohexane-2-ammonium chloride.

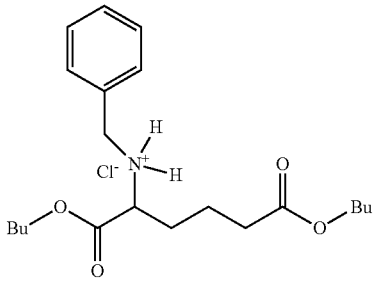

In one embodiment, the amine reactant is not a tertiary hydrocarbyl (e.g., t-alkyl) primary amine, that is, m is not zero while $R^1$, $R^2$, and $R^3$ are each hydrocarbyl groups.

The Michael addition reaction may be conducted in a solvent such as methanol and may employ a catalyst such as a zirconium (Zr)-based catalyst or may be conducted in the absence of catalyst. (A suitable Zr-based catalyst may be prepared by combining an aqueous solution of $ZrOCl_2$ with a substrate such as montmorillonite clay, with heating followed by drying.) Relative amounts of the reactants and the catalyst may be varied within bounds that will be apparent to the person skilled in the art. The ester and the amine may be used in approximately a 1:1 molar ratio, or alternatively with a slight molar excess of one reactant or the other, e.g., a ratio of ester:amine of 0.9:1 to 1.2:1, or 1:1 to 1.1:1, or 1.02:1 to 1.08:1. The amount of Zr catalyst, if used, (excluding support material) may be, for example, 0.5 to 5 g per 100 g of reactants (amine+ester), or 1 to 4 g, or 2 to 3 g, per 100 g of reactants. The Michael addition reaction may be conducted at a temperature of 10 to 33° C., or alternatively 15 to 30° C. or 18 to 27° C. or 20 to 25° C. or yet in other embodiments 10 to 80° C. or 15 to 70° C. or 18 to 60° C. or 20 to 55° C. or 25 to 50° C. or 30 to 50° C. or 45 to 55° C. Solvent may be used during the reaction if desired, and a suitable solvent may be an alcohol such as methanol or other protic solvent, which, in certain embodiments, is preferred. If such a solvent is present, it may be present in an amount of 5 to 80 percent by weight of the total reaction mixture (including the solvent), for instance, 10 to 70% or 12 to 60% or 15 to 50% or 18 to 40% or 20 to 30% or 18 to 25%, or about 20%. The presence of such a solvent may lead to an increased rate of reaction and may facilitate reaction at lower temperatures. In one embodiment 20% methanol is present with dibutyl itaconate and α-methylbenzylamine, and the reaction is conducted at 50° C. Specific optimum conditions may vary depending on the materials employed and can be determined by the person of ordinary skill. At the end of the reaction, the catalyst may be removed by filtration and the solvent, if any, may be removed by evaporation under vacuum. The solvent may be removed under vacuum at a temperature of up to 40° C. or up to 35° C. or up to 30° C. or up to 27° C. or up to 25° C.

The amount of the N-hydrocarbyl-substituted aminoester material in a lubricant may be 0.1 to 5 percent by weight (or 0.2 to 4 or 0.1 to 2 or 0.5 to 5 or 0.8 to 4 or 1 to 3 percent by weight). The material may also be present in a concentrate, alone or with other additives and with a lesser amount of oil. In a concentrate, the amount of material may be two to ten times the above concentration amounts.

The lubricant of the disclosed technology may contain one or more additional components or additives desirable to provide the performance properties of a fully formulated lubricant, e.g., a gear oil, a manual transmission fluid, an automatic transmission fluid, or a farm tractor fluid. Alternatively, any one or more of these components may be excluded from the formulation.

One material that may be used in such a gear oil or driveline formulation is a dispersant, and often a borated dispersant. Dispersants are well known in the field of lubricants and include those known as ashless dispersants and polymeric dispersants. Ashless dispersants are so called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

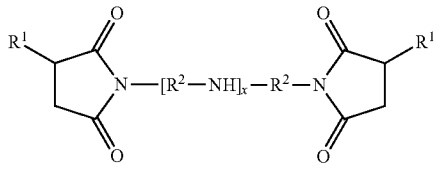

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. Borated dispersants may be prepared by reacting a dispersant with a boron compound such as boric acid. Dispersants may also be post-treated with more than one of the above-mentioned agents, such as a boron compound and a phosphorus compound, a boron compound and a dimercaptothiadiazole compound, or a boron compound, a phosphorus compound, and a dimercaptothiadiazole compound.

The amount of the dispersant in a fully formulated lubricant of the present technology, if it is present, may be at least 0.1% of the lubricant composition, or at least 0.3% or 0.5% or 1%, and in certain embodiments at most 9% or 8% or 6% or 4% or 3% or 2% by weight.

Another material that may be present is an amine phosphate or an amine thiophosphate, that is, an amine salt of a phosphorus acid ester. (The expression "(thio)phosphate" means phosphate or thiophosphate.) This material can serve as one or more of an extreme pressure agent, a wear preventing agent. The amine salt of a phosphorus acid ester includes phosphoric acid esters and salts thereof; dialkyldithiophosphoric acid esters and salts thereof; phosphites; and phosphorus-containing carboxylic esters, ethers, and amides; and mixtures thereof.

In one embodiment the phosphorus compound further comprises a sulfur atom in the molecule. In one embodiment the amine salt of the phosphorus compound is ashless, i.e., metal-free (prior to being mixed with other components).

The amine salt of the phosphorus acid ester may comprise any of a variety of chemical structures. In particular, a variety of structures are possible when the phosphorus acid ester compound contains one or more sulfur atoms, that is, when the phosphorus-containing acid is a thiophosphorus acid ester. The thiophbsphorus acid esters may be mono- or dithiophosphorus acid esters. Thiophosphorus acid esters are also sometimes referred to as thiophosphoric acids. A phosphorus acid ester may be prepared by reacting a phosphorus compound with an alcohol. Suitable phosphorus compound include phosphorus pentoxide, phosphorus trioxide, phosphorous tetroxide, phosphorus acids, phosphorus esters, and phosphorus sulfides such as phosphorus pentasulfide. Suitable alcohols include those containing up to 30 or to 24, or to 12 carbon atoms, including primary or secondary alcohols such as isopropyl, butyl, amyl, s-amyl, 2-ethylhexyl, hexyl, cyclohexyl, octyl, decyl and oleyl alcohols, as well as any of a variety of commercial alcohol mixtures having, e.g., 8 to 10, 12 to 18, or 18 to 28 carbon atoms. Polyols such as diols may also be used.

In one embodiment, the phosphorus acid ester is a monothiophosphoric acid ester or a monothiophosphate. Monotbiophosphates may be prepared by the reaction of a sulfur source with a dihydrocarbyl phosphite. The sulfur source may, for instance, be elemental sulfur, or an organosufide, such as a sulfur coupled olefin or a sulfur coupled dithiophosphate. The preparation of monothiophosphates is disclosed in U.S. Pat. No. 4,755,311 and PCT Publication WO 87/07638, which describe monothiophosphates, sulfur sources, and the process for making monothiophosphates. Monethiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate salt with an amine which is present in the blend.

In certain embodiments, the phosphorus-containing acid is a dithiophosphoric acid or phosphorodithioic acid. The dithiophosphoric acid may be represented by the formula $(RO)_2PSSH$ wherein each R is independently a hydrocarbyl group containing 3 to 30 carbon atoms. R generally contains up to 18, or to 2, or to 8 carbon atoms. Examples of R include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl R groups include butylphenyl, amylphenyl, and heptylphenyl. Examples of mixtures of R groups include 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl, and isooctyl.

In certain embodiments, the dithiophosphoric acid may be reacted with an epoxide or a glycol and this reaction product further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, and styrene oxide. The glycols may be aliphatic glycols having from 1 to 12, or 2 to 6, or 2 or 3 carbon atoms. The dithiophosphoric acids, glycols, epoxides, inorganic phosphorus reagents, and methods of reacting the same are described in U.S. Pat. Nos. 3,197,405 and 3,544,465.

Acidic phosphoric acid esters may be reacted with ammonia or an amine, including polyamines, to form an ammonium salt. The salts may be formed separately and then the salt of the phosphorus acid ester may be added to the lubricating composition. Alternately, the salts may also be formed in situ when the acidic phosphorus acid ester is blended with other components to form a fully formulated lubricating composition.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may typically contain 2 to 30 carbon atoms, or in other embodiments 8 to 26 or 10 to 20 or 13 to 19 carbon atoms.

The amount of the amine salt of the phosphorus acid ester can be 0.04 to 4 percent by weight of the lubricating composition, or 0.1 to 2, or 0.2 to 1, or 0.3 to 0.8, or 0.4 to 0.5 weight percent. The amounts will be proportionally higher in a concentrate. Such materials are more fully described in U.S. Publication 2005/024988.

Another material that may be present is a sulfurized olefin. Sulfurized olefins are well known commercial materials that may be used as friction modifiers, extreme pressure agents, or antioxidants. One such sulfurized olefin is prepared in accordance with the detailed teachings of U.S. Pat. Nos. 4,957,651 and 4,959,168. Described therein is a cosulfurized mixture of two or more reactants selected from the group consisting of (1) at least one fatty acid ester of a polyhydric alcohol, (2) at least one fatty acid, (3) at least one olefin, and (4) at least one fatty acid ester of a monohydric alcohol. Reactant (3), the olefin component, comprises at least one olefin. This olefin may be an aliphatic olefin, which may contain 4 to 40 carbon atoms or 8 to 36 carbon atoms. Terminal olefins, or alpha-olefins, may be used, including those having 12 to 20 carbon atoms. Mixtures of these olefins are commercially available, and such mixtures are contemplated for use in this invention. The co-sulfurized composition of one or more of the above reactants may be prepared by reacting the mixture of appropriate reactants with a source of sulfur. The mixture to be sulfurized can, in one embodiment, contain 10 to 90 parts of Reactant (1), or 0.1 to 15 parts by weight of Reactant (2); or 10 to 90 parts, such as 15 to 60 parts or 25 to 35 parts by weight of Reactant (3), or 10 to 90 parts by weight of reactant (4). The mixture may include includes Reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present invention include elemental sulfur, which is often used, hydrogen sulfide, sulfur halide plus sodium sulfide, or a mixture of hydrogen sulfide and sulfur or sulfur dioxide. Often 0.5 to 3 moles of sulfur may be employed per mole of olefinic bonds. Sulfurized olefins may also include sulfurized oils such as vegetable oil, lard oil, oleic acid and olefin mixtures thereof. The amount of sulfurized olefin, if it is present, may be 0.01 to 5 percent, or 0.1 to 3 percent or 3.1 to 5 percent by weight of a lubricant composition.

Materials that may serve as extreme pressure (EP) agents, having oil solubility, may be present. These include some of the materials listed elsewhere herein as well as other sulfur- and chlorosulfur-containing EP agents, chlorinated hydrocarbon EP agents, and phosphorus EP agents. Examples of such EP agents include chlorinated wax; sulfurized olefins (such as sulfurized isobutylene), organic sulfides and polysulfides such as dibenzyldisulfide, bis-(chlorobenzyl)disulfide, dibutyl tetrasulfide, sulfurized methyl ester of oleic acid, sulfurized alkylphenol, sulfurized dipentene, sulfurized terpene, and sulfurized Diets-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene-substituted phenol phosphite; metal thiocarbamates such as zinc dioctyldithiocarbamate; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Another material that may be present is a substituted thiadiazole such as a dimercaptothiadiazole, which may function as an extreme pressure (EP) agent or a corrosion inhibitor. Examples of suitable thiadiazoles include 2,5-dimercapto-1,3,4-thiadiazole or a hydrocarbyl-substituted 2,5-dimercapto-1,3,4-thiadiazole or a hydrocarbylthio substituted 2,5-dimercapto-1,3,4-thiadiazole. In several embodiments the number of carbon atoms on the hydrocarbyl-substituent group may be 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole. The dimercaptothiadiazole or its derivatives alternatively may be provided by a combination an of oil soluble dispersant with dimercaptothiadiazole. In another embodiment, thiadiazole may be a heptylphenol coupled with 2,5-dimercapto-1,3,4-thiadiazole using formaldehyde (the thiadiazole being generated in situ). In one embodiment, the thiadiazole compound of the present invention may be present in an amount of 0.05 to 8.0 percent by weight, or 0.1 to 4.0 percent by weight, or 0.15 to 2.0 percent by weight of the lubricant composition.

Various lubricants may also contain other additive components. One such component is a metal-containing detergent. Detergents are typically, but not necessarily, overbased materials, otherwise referred to as overbased or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN), the amount of strong acid needed to neutralize all of the material's basicity, expressed as mg KOH per gram of sample. Since overbased detergents arc commonly provided in a form which contains diluent oil, for the purpose of this document, TBN is to be recalculated to an oil-free basis. Some useful detergents may have a TBN of 100 to 800, or 150 to 750, or, 400 to 700. Substantially neutral detergents will have a lower TBN.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium.

The detergent may be a sulfonate detergent, a phenate detergent, a saligenin detergent, a salicylate detergent, a salixarate detergent, or a glyoxylate detergent. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." Overbased salicylate detergents and their methods of preparation are disclosed in U.S. Pat. Nos. 4,719,023 and 3,372,116.

The amount of the overbased detergent, if present, may be at least 0.05 weight percent on an oil-free basis, or 0.7 to 5 weight percent or 1 to 3 weight percent, or 0.05-3, or 0.1-2.8, or 0.1-2.5, or 0.2-2 weight percent. Either a single detergent or multiple detergents can be present.

Another possible additive is a metal salt of a phosphorus acid, which may have many functions including that of an antiwear agent. Metal salts of the formula $$[(R^8O)(R^9O)P(=S)—S]_m\text{-}M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates (ZDP). Such materials are well known and readily available to those skilled in the art of lubricant formulation. Suitable variations to provide good phosphorus retention in an engine are disclosed, for instance, in US published application 2008-0015129, see, e.g., claims. The amount of a metal salt of a phosphorus acid, if present, may be 0.3 to 1.0, or 0.5 to 0.8 weight percent.

Another possible additive is a dialkylphosphite such as dibutylphosphite or di(2-ethylhexyl)phosphite or dioleylphosphite. Polymeric phosphorus esters may also be used; such materials may be described as the condensation product of (i) a monomeric phosphorus acid or an ester thereof with (ii) a diol. The two hydroxy groups of the diol may be separated by a chain of 4 to 100 carbon atoms, and the chain may optionally include one or more oxygen or sulfur atoms. Polymeric phosphorus esters are described in greater detail in WO 2010/126760. The amount of a dialkylphosphite, if present, may be 0.02 to 0.5, or 0.02 to 0.4, or 0.02 to 0.35, or 0.05 to 3, or 0.2 to 2, or 0.2 to 1.5, or 0.05 to 1.5, or 0.2 to 1, or 0.2 to 0.7 weight percent.

Another possible additive is a friction modifier, which may be described as an ashless friction modifier if it does not contain metal. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| | |
|---|---|
| fatty phosphites | borated alkoxylated fatty amines |
| fatty acid amides | metal salts of fatty acids |
| fatty epoxides | sulfurized olefins |
| borated fatty epoxides | fatty imidazolines |
| fatty amines | condensation products of carboxylic |
| glycerol esters | acids and polyalkylene-polyamines |
| borated glycerol esters | metal salts of alkyl salicylates |
| alkoxylated fatty amines | amine salts of alkylphosphoric acids |
| oxazolines | ethoxylated alcohols |
| hydroxyalkyl amides | imidazolines |
| dialkyl tartrates | polyhydroxy tertiary amines |
| molybdenum compounds | and mixtures of two or more thereof. |

The amount of a friction modifier, if present, may be 0.1 to 5, or 0.2 to 3, or 0.3 to 3, or 0.25 to 2.5 weight percent.

Another possible additive is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylamino-propyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12%, or 3 to 10% by weight may be used.

Another component may be an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine, or an alkylated phenylnaphthylamine, or mixtures thereof.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Other materials that may serve as antioxidants include titanium compounds. U.S. Patent Application Publication 2006-0217271 discloses a variety of titanium compounds, including titanium alkoxides and titanated dispersants, which materials may also impart improvements in deposit control and filterability. Other titanium compounds include titanium carboxylates such as neodecanoate.

Typical amounts of antioxidants will, depend on the specific antioxidant and its individual effectiveness, but illustrative total amounts can be 0.01 to 5 percent by weight or 0.15 to 4.5 percent or 0.2 to 4 percent.

Materials that may be used as antiwear agents include tartrate esters, tartramides, and tartrimides. Examples include oleyl tartrimide (the imide formed from oleylamine and tartaric acid) and oleyl diesters (from, e.g., mixed C12-16 alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxy-propionic acid, hydroxy-glutaric acid, and mixtures thereof. These materials may also impart additional functionality to a lubricant beyond anti-wear performance. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.1 weight % to 5 weight %, or 0.2 weight % to 3 weight %, or greater than 0.2 weight % to 3 weight %. Other anti-wear agents include borate esters (including borated epoxides), dithiocarbamate compounds, molybdenum-containing compounds, and sulfurized olefins, and they may be present in comparable amounts.

Other additives that may optionally be used in lubricating oils include pour point depressing agents, extreme pressure agents, anti-wear agents, color stabilizers and anti-foam agents.

The lubricant composition of the present technology can find use in various applications including as a lubricant composition for a gear, an axle, a manual transmission, an automatic transmission, or a farm tractor.

The lubricant of the disclosed technology may be in the form of a gear oil. In such an instance the lubricant may contain, in addition to an oil of lubricating viscosity and other conventional components, (a) an olefin sulfide (such as dibutyl polysulfide or sulfurized isobutylene, or a mixture thereof), in an amount of 0.1-5 percent, or, 0.5-4 percent, or 1-3 percent by weight; (b) a dispersant such as a succinimide dispersant (optionally borated, optionally reacted with a dimercaptothiadiazole, in an amount of 0.1-2 percent, or 0.5-1.5 percent, or 0.75-1.5 percent by weight; (c) a corrosion inhibitor such as a dimercaptothiadiazole or substituted dimercaptothiadiazole, in an amount of 0.1-0.5 percent, or 0.2-0.4 percent, or 0.25-0.35 percent by weight; (d) one or more phosphorus-containing additives in an amount to provide to the formulation a P content of 100-1000 ppm, 100-800 ppm, or 200-600 ppm by weight; and one or more sulfur-containing additives such as sulfurized olefins in an amount to provide to the formulation a S content of 0.3-5 percent, or 0.5-3 percent, or 0.8-2.5 percent, or 1-2 percent by weight.

The lubricant of the disclosed technology may be in the form of a manual transmission fluid. In such an instance the lubricant may contain, in addition to an oil of lubricating viscosity and other conventional components, (a) one or more metal-containing detergents, where the metal may be Ca or Mg and the detergent substrate may be sulfonate or phenate; the detergent may be overbased and may have a TBN or at least 200 or 250-1000, or 450-900 or 650-800 (on an oil free basis), and it may be present in an amount of 0.1-4 percent, 0.2-3.5 percent, 0.5-3 percent, or 0.5-2 percent by weight; (b) one or more di or tri-hydrocarbyl phosphites (where the hydrocarbyl groups each may containing, for instance 2-8 carbon atoms), in an amount of 0.05-3 percent, 0.2-2 percent, 0.2-1.5 percent, 0.05-1.5 percent, 0.2-1 percent, or 0.2-0.7 percent by weight; (c) a corrosion inhibitor such as a dimercaptothiadiazole or substituted dimercaptothiadiazole, in an amount of 0.1 to 0.3 percent, or 0.15-0.25 percent by weight; (d) a dispersant such as a succinimide dispersant (optionally borated, optionally reacted with a dimercaptothiadiazole), in an amount of 0.1-5 percent, or 0.3-4 percent, or 0.5 to 4 percent, or 0.1 to 3 percent, or 1 to 3 percent by weight; (e) wherein the formulation may have a Ca content of 0.03-1.0 percent, or 0.6-0.6 percent or 0.2-0.5 percent by weight; and (f) wherein the formulation may have a P content derived from a phosphorus-containing component such as an antiwear agent of 100-2000 ppm, 150-1500 ppm, 200-1000, or 250-800 ppm by weight; and (g) wherein the fluid may optionally contain a zinc dialkyldithiophosphate in an amount of 0.5-1.5 percent by weight and/or an amine salt of a phosphorus acid ester in an amount of 0.3-1.0 percent by weight.

The lubricant of the disclosed technology may be in the form of an automatic transmission fluid. In such an instance the lubricant may contain, in addition to an oil of lubricating viscosity and other conventional components, (a) at least one dispersant such as a succinimide dispersant (optionally borated, optionally treated with phosphorus, optionally reacted with a dimercaptothiadiazole), in an amount of 1-5 percent, or 1-4 percent, or 1.5-4 percent, or 1.5-3 percent by weight; (b) at least one phosphorus containing antiwear agent (such as (i) a non-ionic phosphorus compound, e.g., a hydrocarbyl phosphite); (ii) an amine salt of a phosphorus compound; (iii) an ammonium um salt of a phosphorus compound) which delivers 350-950 ppm, 450-850 ppm, or 500-800 ppm phosphorus to the lubricant; (c) at least one metal containing detergent (which may be overbased or substantially neutral) in an amount to deliver 110-700 ppm, 130-600 ppm, 150-500 ppm or 160-400 ppm metal such as calcium to the lubricant; and (d) at least one ashless friction modifier in an amount of 0.1-4 percent, 0.2-3 percent, 0.3-3 percent, or 0.25-2.5 percent by weight.

The lubricant of the disclosed technology may be in the form of a farm tractor fluid. In such an instance the lubricant may contain, in addition to an oil of lubricating viscosity and other conventional components, (a) at least one dispersant such as a succinimide dispersant (optionally borated, optionally treated with phosphorus, optionally reacted with a dimercaptothiadiazole), in an amount of 0.1-3 percent, or 0.1-2.5 percent, or 0.2-2 percent by weight; (b) at least one phosphorus containing antiwear agent (such as (i) a non-ionic phosphorus compound, e.g., a hydrocarbyl phosphite; (ii) an amine salt of a phosphorus compound; (iii) an ammonium salt of a phosphorus compound) which delivers 200-1500 ppm, 500-1300 ppm, or 700-1300 ppm phosphorus to the lubricant; (c) a sulfur-containing extreme pressure agent (such as dimercaptothiadiazole or a substituted dimercaptothiadiazole) in an amount of 0.05-1.0 percent, or 0.1-0.7 percent, or 0.15-0.5 percent by weight; (d) a sulfur containing corrosion inhibitor (such as dimercaptothiadiazole or a substituted dimercaptothiadiazole) in an amount of 0.15-0.35 percent or 0.15-0.3 percent by weight; (d) at least one metal containing detergent (which may be overbased or substantially neutral) in an amount of 0.2 to 1.5 percent or 0.25 to 1.2 percent or 0.3 to 1.0 percent by weight, to deliver 100-3000 ppm, 200-2000 ppm, or 300-900 ppm metal such as calcium to the lubricant; (e) wherein the sulfur content of the lubricant may be 2000-5500 ppm, 2000-5000 ppm, or 2100-4700 ppm by weight.

As used in this document, expressions such as "represented by the formula" indicate that the formula presented is generally representative of the structure of the chemical in question. However, minor variations can occur, such as positional isomerization. Such variations are intended to be encompassed.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen.

In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Preparation of an N-hydrocarbyl-substituted aminoester. Bis(2-ethylhexyl)itaconate (47.0 g), methanol (100 g), and 5.0 g of a Zr based catalyst are charged to a 250 mL 3-neck flask fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 16.3 g of 2-ethylhexylamine is added dropwise over 15 minutes (or alternatively, 3-4 minutes), during which time the temperature of the mixture is 18-27° C. (alternatively, up to 30° C. or 33° C.). The mixture is stirred for an additional 5 hours, then filtered to remove the catalyst. Methanol is removed from the filtrate by rotary vacuum drying under high vacuum, maintaining the temperature below 25° C. The product is believed to be bis(2-ethylhexyl)2-((2-ethylhexyl)amino) methyl succinate, 49.5 g. The product has a TBN of 74.2 as measured by D4739.

Examples 2 Through 6

The procedure of Example 1 is substantially duplicated using the reactants shown in the following Table. Each used 0.66 g of the Zr catalyst (amount based on active $ZrOCl.8H_2O$, excluding amount of substrate) and ~25 mL of methanol solvent:

TABLE I

| Ex. | Material | Amount |
|---|---|---|
| 2 | Dibutyl itaconate | 20.0 g |
| | 2-Ethylhexylamine | 10.1 g |
| | Product, 49 TBN[a] | |
| 3 | Dibutyl itaconate | 20.0 g |
| | Isopropylamine | 4.6 g |
| | Product, 121 TBN | |
| 4 | Dibutyl itaconate | 25.0 g |
| | sec-Butylamine | 7.2 g |
| | Product, 69 TBN | |
| 5 | Dibutyl itaconate | 25.0 g |
| | iso-Butylamine | 7.2 g |
| | Product, 132 TBN | |
| 6 | Dibutyl itaconate | 25.0 g |
| | Cyclohexylamine | 9.7 g |
| | Product, 127 TBN | |

Examples 7, and 8 and Example 7a

Additional products are made by similar reactions, in methanol solvent, using the reactants shown in the table below. An alternative and more detailed preparation of the material of Example 7 (referred to as Example 7a) is also reported here:

Example 7a

Dibutyl itaconate (100 parts by weight) and methanol (39.7 parts by weight) are charged to a 3-neck vessel fitted with a condenser, magnetic stirrer, nitrogen inlet, and thermocouple. The mixture is stirred and 45 parts by weight of α-methylbenzylamine is added dropwise over about 45 minutes, during which time the temperature of the mixture is maintained at about 24-27° C. The mixture is then heated to about 50° C. and stirred for approximately 20 hours, and thereafter the methanol is removed by rotary vacuum drying under high vacuum, maintaining the temperature below 40° C. The product is believed to be dibutyl 2-(α-methylbenzyl amino)succinate, 140.7 parts by weight. The product has a TBN of 144.2 (by ASTM D 4739).

TABLE II

| | |
|---|---|
| Ex 7 | Dibutyl itaconate<br>α-Methylbenzylamine[b]<br>Product TBN 117 |
| Ex 7a | Dibutyl itaconate<br>α-Methylbenzylamine[b]<br>Product TBN 144.2 |
| Ex. 8 | Dibutyl itaconate<br>Cyclopentylamine<br>Product TBN 102 |

All TBNs by D4 739 b. The S-enantiomer is used. In all instances where a chiral center occurs, it is believed that either the R or S enantiomer may be used, or racemic mixtures thereof.

Example 9

Preparation of an N-hydrocarbyl-substituted γ-aminoester without catalyst. Dibutyl itaconate (100 g) and methanol (158 g) are charged to a 250 mL 3-neck flack fitted with a condenser, magnetic stirrer, nitrogen inlet, and thermocouple. The mixture is stirred at room temperature, and 23.17 g of isopropylamine is added dropwise over 45 minutes (or, alternatively, 3-4 minutes), during which time the temperature of the mixture is 18-27° C. (alternatively, up to 30° C. or 33° C.; the temperature may depend, in part, on the boiling point of the amine: the boiling point of isopropylamine is about 32° C.). The mixture is stirred for an additional 5 hours and thereafter the methanol is removed by rotary vacuum drying under high vacuum, maintaining the temperature below 35° C. The products is dibutyl 2-(isopropylamino)succinate, 113.14 g. The product has a TBN of 110 (D 4739).

Example 10

In a similar procedure, 100 g dibutylitaconate is reacted with 38.9 g cyclohexylamine. The product has a TBN of 114 (D 4739).

Example 12

Preparation of an N-hydrocarbyl-substituted δ-aminoester. Bis(2-ethylhexyl)-2-methyleneglutaric acid (48.9 g), methanol (100 g), and 5.0 g of a Zr based catalyst are charged to a 250 mL 3-neck flask fitted with a condenser, magnetic stirrer, nitrogen inlet, and thermocouple. The mixture is stirred at room temperature and 16.3 g of 2-ethylhexylamine is added dropwise over 15 minutes (or alternatively, 3-4 minutes), during which time the temperature of the mixture is 18-27° C. (alternatively, up to 30° C. or 33° C.). The mixture is stirred for an additional 5 hours, then filtered to remove the catalyst. Methanol is removed from the filtrate by rotary vacuum drying under high vacuum, maintaining the temperature below 25° C. The product will be bis(2-ethylhexyl) 2-((2-ethylhexyl)amino)methyl glutarate.

Lubricant Examples 13-25

Each of the products of Examples 1 through 12 (including Example 7a) is added to an oil of lubricating viscosity in an amount of about 2 percent by weight. Also included in the lubricant is 2,5-dimercapto-1,3,4-thiadiazole in an amount of about 0.5 percent by weight.

Lubricant Examples 26-38

Each of the products of Examples 1 through 12 (including Example 7a) is added to an oil of lubricating viscosity in an amount of about 2 percent by weight. Also included in the lubricant is a $C_{12-14}$ alkylamine salt of a complex mixture of predominantly di-$C_6$ alkyl phosphoric acid and dithiophosphoric acids, in an amount of about 0.4 percent by weight.

The materials of the disclosed technology will give good iron corrosion (rust) performance when subjected to the ISO 6270-2 test and good copper corrosion performance when subjected a copper corrosion test.

The corrosion test ISO 6270-2 is an International Standard (ISO) and involves submerging a steel plate, of set dimensions, in the test fluid then allowing it to drain overnight; it is then placed in a humidity cabinet in triplicate. The test runs for 12 cycles; each cycle is 24 hours in duration and consists of 8 hours at 100% humidity and 16 hours at rest. The test plate is evaluated after 6 and 12 cycles, and the amount of rust present after 12 cycles is reported for each side of each test plate.

A suitable copper corrosion test is performed generally according to ASTM D130 and involves suspending a copper strip, of known mass, in a test fluid (100 mL) and passing air (5 L/hour) through the fluid (160° C., 168 hours). The test reports the copper content of the test fluid at the end of the test along with the ASTM D130 rating.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) an oil of lubricating viscosity;

(b) an N-hydrocarbyl-substituted aminoester represented by the formula

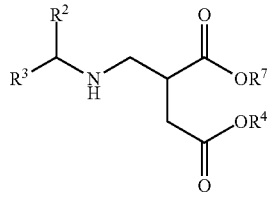

wherein $R^2$ and $R^3$ are independently alkyl groups of 1 to about 6 carbon atoms and $R^4$ and $R^7$ are independently alkyl groups of 1 to about 12 carbon atoms; and (c) about 0.05 to about 8 percent by weight of a substituted thiadiazole or about 0.04 to about 4 percent by weight of an amine (thio)phosphate.

2. The lubricant composition of claim 1 further comprising at least one of extreme pressure agents, detergents, dispersants, antioxidants, corrosion inhibitors, and antiwear agents.

3. The lubricant composition of claim 1 wherein the N-hydrocarbyl-substituted aminoester is present in an amount of about 0.1 to about 5 percent by weight.

4. The lubricant composition of claim 1 wherein the lubricant composition comprises a substituted thiadiazole.

5. The lubricant composition of claim 1 wherein the lubricant composition comprises an amine (thio)phosphate.

6. A method for lubricating a gear or a driveline device, comprising supplying thereto the lubricant composition of claim 1.

7. The method of claim 6 wherein the gear or driveline device comprises a gear, an axle, a manual transmission, an automatic transmission, or a farm tractor.

8. A lubricant composition comprising:

(a) an oil of lubricating viscosity;

(b) an N-hydrocarbyl-substituted aminoester is represented by the formula

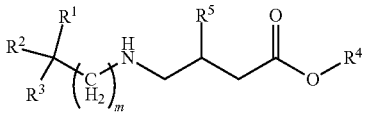

wherein m is 0 or 1, $R^1$ is hydrogen or a hydrocarbyl group, $R^2$ and $R^3$ are independently hydrocarbyl groups or together form a carbocyclic structure, $R^4$ is an ether-containing group or a polyether-containing group, having 2 to about 120 carbon atoms, and $R^5$ is hydrogen, a hydrocarbyl group, or a group represented by —C(═O)—$R^6$ where $R^6$ is hydrogen, an alkyl group, or —O—$R^7$, where $R^7$ is a hydrocarbyl group of 1 to about 30 carbon atoms, provided that if $R^4$ is methyl, then m is 0, and further provided that if m is 0, $R^1$ is hydrogen; and (c) about 0.05 to about 8 percent by weight of a substituted thiadiazole or about 0.04 to about 4 percent by weight of an amine (thio)phosphate.

9. The lubricant composition of claim 8 wherein $R^4$ is represented by

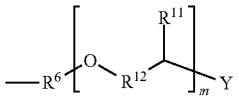

wherein $R^6$ is a hydrocarbyl group of 1 to about 30 carbon atoms;

$R^{11}$ is H or a hydrocarbyl group of 1 to about 10 carbon atoms;

$R^{12}$ is a straight or branched chain hydrocarbylene group of 1 to 6 carbon atoms;

Y is —H, —OH, —$R^6$OH, $NR^9R^{10}$, or —$R^6NR^9R^{10}$, where $R^9$ and $R^{10}$ are each independently H or a hydrocarbyl group of 1 to 50 carbon atoms, and m is an integer from 2 to 50.

10. The lubricant composition of claim 8 further comprising at least one of extreme pressure agents, detergents, dispersants, antioxidants, corrosion inhibitors, and antiwear agents.

11. The lubricant composition of claim 8 wherein the N-hydrocarbyl-substituted aminoester is present in an amount of about 0.1 to about 5 percent by weight.

12. The lubricant composition of claim 8 wherein the lubricant composition comprises a substituted thiadiazole.

13. The lubricant composition of claim 8 wherein the lubricant composition comprises an amine (thio)phosphate.

14. A lubricant composition comprising:

(a) an oil of lubricating viscosity;

(b) an N-hydrocarbyl-substituted aminoester is represented by the formula

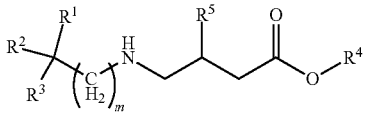

wherein m is 0 or 1, $R^1$ is hydrogen or a hydrocarbyl group, $R^2$ and $R^3$ are independently hydrocarbyl groups or together form a carbocyclic structure, $R^4$ is a hydroxy-containing or a polyhydroxy-containing alkyl group of 2 to about 12 carbon atoms, at least one hydroxy group being optionally reacted to form an ester or a thioester, and $R^5$ is hydrogen, a hydrocarbyl group, or a group represented by —C(═O)—$R^6$ where $R^6$ is hydrogen, an alkyl group, or —O—$R^7$, where $R^7$ is a hydrocarbyl group of 1 to about 30 carbon atoms, provided that if $R^4$ is methyl, then m is 0, and further provided that if m is 0, $R^1$ is hydrogen; and (c) about 0.05 to about 8 percent by weight of a substituted thiadiazole or about 0.04 to about 4 percent by weight of an amine (thio)phosphate.

15. The lubricant composition of claim 14, further comprising at least one of extreme pressure agents, detergents, dispersants, antioxidants, corrosion inhibitors, and antiwear agents.

16. The lubricant composition of claim 14, wherein the N-hydrocarbyl-substituted aminoester is present in an amount of about 0.1 to about 5 percent by weight.

17. The lubricant composition of claim 14, wherein the lubricant composition comprises a substituted thiadiazole.

18. The lubricant composition of claim 14, wherein the lubricant composition comprises an amine (thio)phosphate.

19. A lubricant composition comprising:

(a) an oil of lubricating viscosity;

(b) an N-hydrocarbyl-substituted aminoester represented by formula

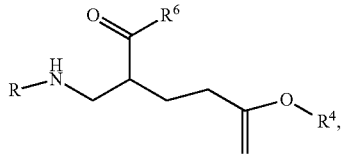

wherein,

R is a hydrocarbyl group having from 1 to 30 carbon atoms;

$R^6$ is —O—$R^7$, where IC is a hydrocarbyl or hydrocarbon group having from 1 to 30 carbon atoms;

$R^4$ is a hydrocarbyl or hydrocarbon group having from 1 to 30 carbon atoms, and (c) about 0.05 to about 8 percent by weight of a substituted thiadiazole or about 0.04 to about 4 percent by weight of an amine (thio)phosphate.

20. The lubricant composition of claim 19, further comprising at least one of extreme pressure agents, detergents, dispersants, antioxidants, corrosion inhibitors, and antiwear agents.

21. The lubricant composition of claim 19, wherein the N-hydrocarbyl-substituted aminoester is present in an amount of about 0.1 to about 5 percent by weight.

22. The lubricant composition of claim 19, wherein the lubricant composition comprises a substituted thiadiazole.

23. The lubricant composition of claim 19, wherein the lubricant composition comprises an amine (thio)phosphate.

* * * * *